US009979104B2

(12) United States Patent
Falchetti

(10) Patent No.: US 9,979,104 B2
(45) Date of Patent: May 22, 2018

(54) CLAMPS FOR MALE TERMINALS

(71) Applicant: MTA S.p.A., Codogno (IT)

(72) Inventor: Antonio Falchetti, Codogno (IT)

(73) Assignee: MTA S.p.A., Codogno (LO) (IT)

( * ) Notice: Subject to any disclaimer, the term of this patent is extended or adjusted under 35 U.S.C. 154(b) by 0 days. days.

(21) Appl. No.: 15/637,412

(22) Filed: Jun. 29, 2017

(65) Prior Publication Data

US 2018/0006387 A1 Jan. 4, 2018

(30) Foreign Application Priority Data

Jun. 30, 2016 (IT) ..... 102016000068125

(51) Int. Cl.

| | |
|---|---|
| ***H01R 4/38*** | (2006.01) |
| ***H01R 11/28*** | (2006.01) |
| ***H01R 11/26*** | (2006.01) |
| ***H01R 11/24*** | (2006.01) |

(52) U.S. Cl.

CPC ..... *H01R 11/283* (2013.01); *H01R 11/24* (2013.01); *H01R 11/26* (2013.01); *H01R 11/282* (2013.01)

(58) Field of Classification Search

CPC ..... H01R 11/283; H01R 11/26; H01R 11/24; H01R 11/281; H01R 11/287; H01R 11/282; H01R 11/285

See application file for complete search history.

(56) References Cited

U.S. PATENT DOCUMENTS 5,302,143 A 4/1994 Inoue et al.
5,558,544 A * 9/1996 Okada ..... H01R 11/282 439/762
8,317,549 B2 * 11/2012 Falchetti ..... H01R 11/283 439/762
9,590,325 B2 * 3/2017 Tanigawa ..... H01R 11/283
9,774,110 B1 * 9/2017 Ritchie ..... H01R 4/308

FOREIGN PATENT DOCUMENTS

EP 2372845 A1 10/2011
EP 2940758 A1 11/2015

OTHER PUBLICATIONS

Italian Search Report dated May 8, 2017, in corresponding Italian Application No. IT UA20164795, 12 pages.

* cited by examiner

*Primary Examiner* — Xuong Chung Trans

(74) *Attorney, Agent, or Firm* — MH2 Technology Law Group, LLP

(57) ABSTRACT

A clamp for a male terminal having features for preventing incorrect clamping, which comprises a main body having a ring and two jaws, that are movable toward each other for the ring to hold the terminal. An engagement element is movable in the vertical direction and to act upon the jaws to move them toward each other. A clamping member, operable to move the engagement element comprises a stem and a nut. The stem is fixed to a base body, which is pivotable relative to the main body between a first position, in which the stem is inclined with respect to the vertical and a second position, in which the stem extends in the vertical direction. In the first position, the engagement element prevents the nut from engaging a threaded portion of the stem. In the second position, the threaded portion is adapted to be engaged by the nut.

10 Claims, 3 Drawing Sheets

CLAMPS FOR MALE TERMINALS

CROSS-REFERENCE TO RELATED APPLICATION(S)

This application claims priority under 35 U.S.C. § 119 from Italian Patent Application No. 102016000068125, filed on Jun. 30, 2016, in the Italian Patent and Trademark Office ("IPTO"), the entire contents of which are incorporated herein by reference.

TECHNICAL FIELD

The present invention relates to a clamp for a male terminal, preferably for a battery pole in automotive applications. Namely, the present invention relates to a vertically screwed clamp.

BACKGROUND OF THE INVENTION

Prior art clamps comprise a clamping ring, coupled to two jaws. The terminal in fitted into the clamping ring and as the jaws move toward each other, the ring is clamped to the terminal. A screw and a nut can keep the jaws together and the ring clamped on the terminal during operation. This will allow current to flow from the terminal to an external cable through the clamp.

Particularly, vertically screwed clamps are equipped with a clip which engages the jaws and may slide relative to the jaws, parallel to the direction of insertion of the terminal into the ring. The clip has inclined surfaces such that its movement will cause the jaws to move toward each other.

The screw is also arranged parallel to the direction of insertion of the terminal. Particularly, the screw shank is placed between the jaws and extends through a hole of the clip. As the clip is pressed upon the jaws by the screw and the nut, the ring is maintained in its clamping position.

A clamp of this type is disclosed, for example, in U.S. Pat. No. 5,302,143.

In automotive applications, particularly in farm vehicles, the clamp is subject to strong vibration. Due to such vibration, the clamp may slip off the battery pole even once the nut and screw have been tightened on the clamp, obviously leading to drawbacks for vehicle operation. Access to the hood of the vehicle is required to act upon the clamp and fit it back onto the battery pole.

This drawback may be avoided by properly positioning the clamp on the battery pole before tightening the nut on the screw. Particularly, the clamp shall be well fitted on the battery pole and pressed against the outer surface of the battery, and the clamping ring shall be oriented perpendicular to the direction of insertion of the battery pole.

The object of the present invention is to solve the above discussed problem by providing a clamp in which the screw and the nut can be only tightened on the clamp if the clamp is in a proper position relative to the terminal. Thus, once the screw and the nut have been tightened, the risk that the clamp might inadvertently slip off the terminal is greatly reduced.

SUMMARY OF THE INVENTION

This and other purposes are achieved by a clamp for a male terminal as defined in any of the accompanying claims.

Advantageously, for the nut to grip on the screw, the base body must be laid on the battery at the terminal, and the main body of the clamp must be pressed toward the battery, to thereby overcome the resistance of the elastic members and move the base body to the second position. Thus, the clamp may be clamped on the battery pole only when it is in the proper position.

BRIEF DESCRIPTION OF THE DRAWINGS

Further features and advantages of the clamp for a male terminal of the present invention will be apparent from the following description of one preferred embodiment thereof, which is given by way of illustration and without limitation with reference to the accompanying figures, in which.

DETAILED DESCRIPTION OF THE INVENTION

Figure 1:
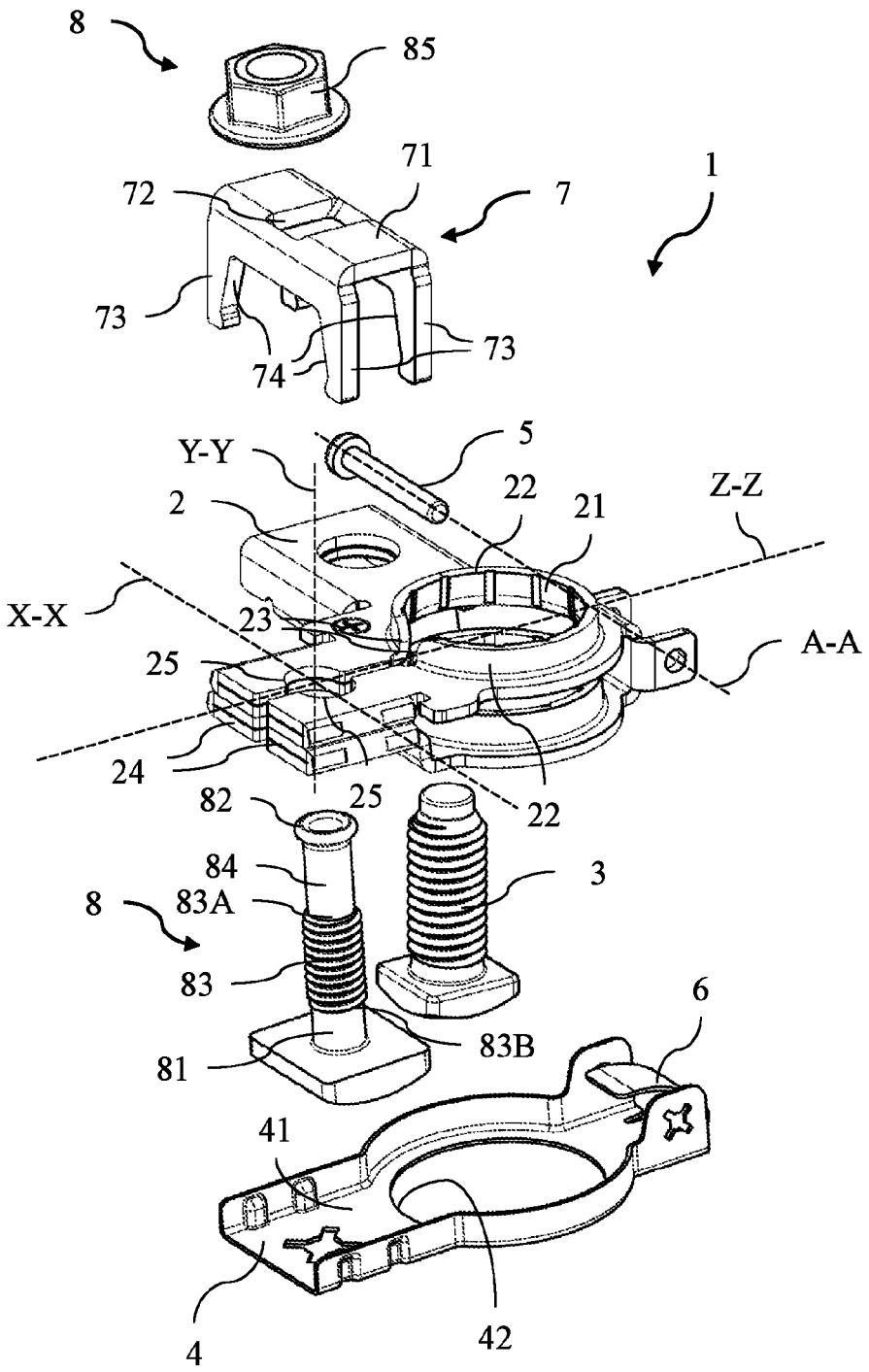
FIG. 1 shows an exploded perspective view of a clamp of the invention.

Referring to the accompanying figures, numeral 1 generally designates a clamp. The clamp 1 is designed to be applied to a male terminal, preferably a battery pole, not shown. Particularly, the clamp 1 is a vertically screwed clamp, as described in greater detail below.

The clamp 1 comprises a main body 2, having a clamping ring 21. The clamping ring 21 is adapted to receive the male terminal, i.e. may be slipped on and off the male terminal. The clamping ring 21 is deformable such that it may be clamped on the male terminal to hold it. Particularly, the clamping ring 21 has two arms 22 that are movable toward each other in a first direction X-X. Each arm 22 has a free end 23.

The main body 2 further comprises two jaws 24. The jaws are spaced apart in the first direction X-X. The jaws 24 are also movable toward each other in the first direction X-X to bring the clamping ring 21 to a clamping position in which it is configured to hold the male terminal. Particularly, each jaw 24 extends from a respective free end 23 of an arm 22 of the clamping ring 21. The two jaws 24 define a channel 25. The channel 25 is adapted to have a stem extending therethrough, as explained in further detail below.

The main body 2 is coupled to a contact element 3, e,g, a screw contact element 3. The contact element 3 is configured to make electrical contact with a power distributing member, such as a cable, not shown.

The clamp 1 comprises a base body 4. The base body 4 is adapted to be laid on an outer surface of a battery, at the aforementioned battery pole. For this purpose, the base body 4 has a flat base surface 41. The base body also has a hole 42 for the male terminal to extend therethrough.

Figure 2:
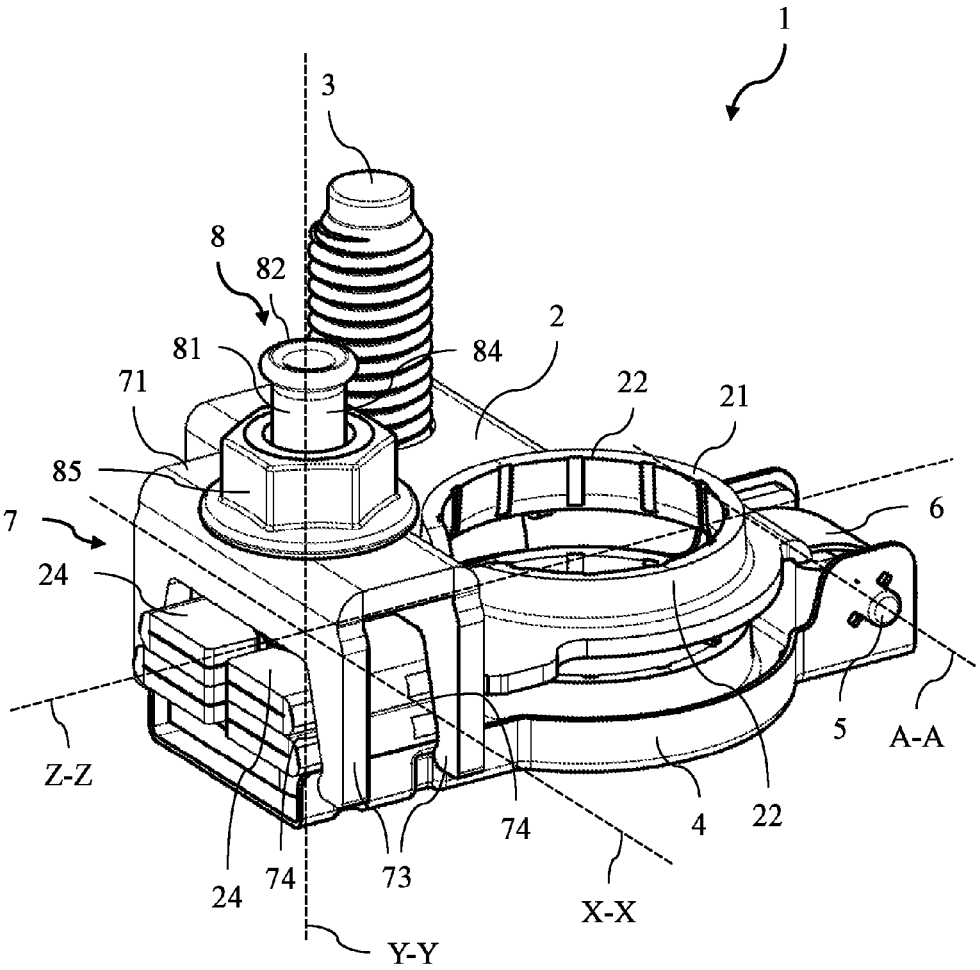
FIG. 2 shows a perspective view of the clamp of FIG. 1 in a first configuration.
Figure 3:
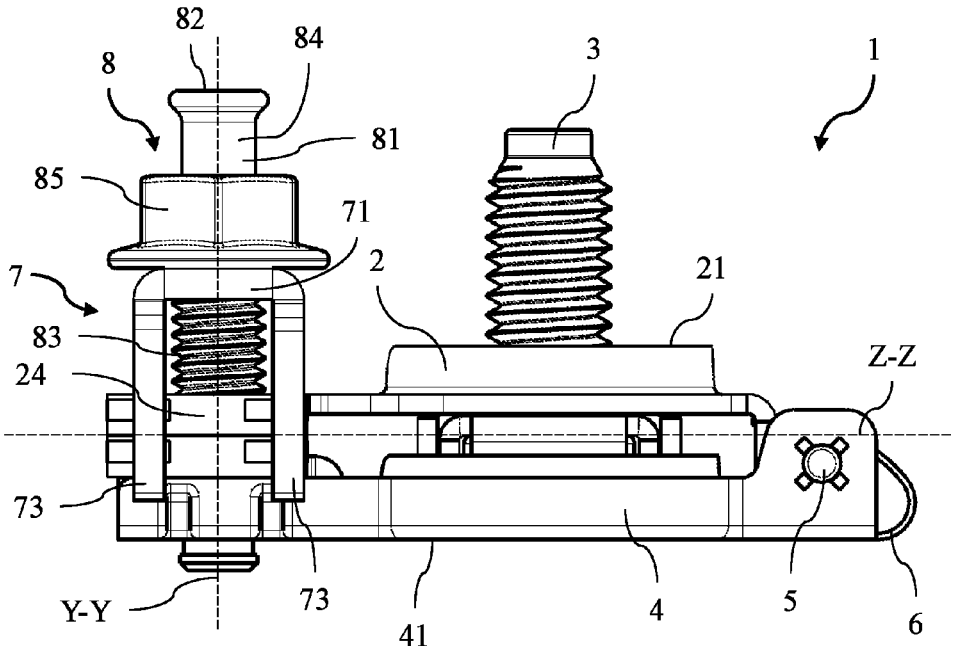
FIG. 3 shows a side view of the clamp of FIG. 2.
Figure 4:
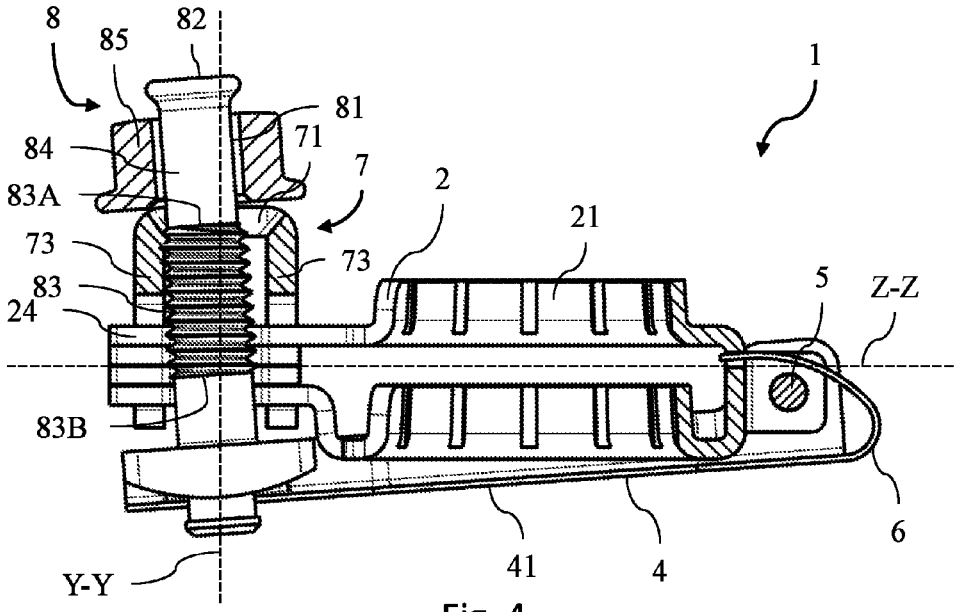
FIG. 4 shows a sectional view of the clamp of FIG. 1 in a different configuration.

The base body 4 is pivotally connected to the main body 2 to switch between a first position as shown in FIGS. 2 and 3, and a second position, as shown in FIG. 4. As described in greater detail below, clamping of the ring 21 is only allowed in the second position.

In the first position, the base body 4 is spaced apart from the clamping ring 21, i.e. the jaws 24, in a second direction Y-Y perpendicular to the first direction. In the second position, the base body 4 is disposed substantially parallel to the main body 2. Particularly, in the second position the base body 4 is disposed adjacent to the clamping ring 21. Furthermore, in the second position the base body 4 and particularly the base surface 41 is disposed perpendicular to the second direction Y-Y.

In other words, assuming that the base surface 41 rests on a horizontal surface, in the second position the base body 4 and the main body 2 are oriented horizontally, whereas the second direction Y-Y is oriented vertically.

The clamp 1 comprises a hinge 5 between the base body 4 and the main body 2. The base body 4 is hinged to the main body 2 at the hinge 5 to pivot relative to the main body 2. Particularly, the base body 4 is pivotable relative to the main body 2 about an axis of rotation A-A extending parallel to the first direction X-X.

Preferably, the clamping ring 21 is interposed between the hinge 5 and the jaws, which means that the jaws 24 are in a distal position relative to the hinge 5. The hinge 5 and the jaws 24 are spaced apart in a third direction Z-Z perpendicular to the first direction X-X and the second direction Y-Y. Advantageously, even a limited pivotal motion of the base body 4 relative to the main body 2 causes a considerable displacement of the base body relative to the jaws.

The clamp 1 comprises elastic members 6 interposed between the base body 4 and the main body 2. The elastic members 6 are configured to maintain the base body 4 in the first position with an elastic load. In other words, the elastic members 6 are configured to counteract the movement of the base body 4 from the first position to the second position as the elastic load is overcome. Particularly, the elastic members 6 are configured to be loaded in the second position.

In the embodiment as shown in the accompanying figures, the elastic members 6 are formed of one piece with the base body 4. Moreover, the elastic members 6 are located proximate to the hinge 5.

For the base body 4 to be moved from the first position to the second position, thereby allowing clamping of the clamping ring 21, the base body 2 may be laid on the surface of the battery and the main body 2 may be pressed toward the based body 4, i.e. toward the battery. This step will be carried out with the battery pole extending through the hole 42 of the base body 4 and the clamping ring 21, and will ensure that the clamp 1 will be properly positioned relative to the battery pole, with the base body 4 in the second position.

The clamp 1 comprises an engagement element 7, which is movable relative to the main body 2 in the second direction Y-Y. The engagement element 7 acts upon the jaws 24 to cause the jaws 24 to move toward each other in the first direction X-X. Particularly, the engagement element 7 has a fixing portion 71 with a slit 72. The slit 72 is adapted to have a stem extending therethrough, as explained in further detail below. The engagement element 7 also has at least one engagement member 73 that projects out of the fixing portion 71. Each engagement member 73 extends substantially in the second direction Y-Y. In the illustrated embodiment, the engagement element has four engagement members 73.

Each engagement member 73 has an engagement surface 74 that is inclined with respect to the second direction Y-Y. Each engagement member 73 is configured to engage a respective jaw 24 at the engagement surface 74. Particularly, each engagement member 73 is configured to press its respective jaw 24 toward the other jaw 24 as the engagement element 7 moves in the second direction Y-Y toward the base body 4. Each engagement member 73 is further configured to allow the jaws 24 to move away from each other as the engagement element 7 moves in the second direction Y-Y away from the base body 4.

The clamp 1 comprises a clamping member 8, which is operable to move the engagement element 7 relative to the main body 2 in the second direction Y-Y. The clamping member 8 comprises a stem 81. The clamping member 8 also comprises a threaded nut 85 coupled with the stem 81.

In the illustrated embodiment, the stem 81 consists of the shank 81 of a screw. The stem 81 is fixed to the base body 4. Particularly, the stem 81 is not able to rotate relative to the base body 4. However, the stem 81 is able to rotate relative to the main body 2 and the engagement element 7, jointly with the base body 4. Particularly, the stem 81 is rotatable about the axis of rotation A-A. It shall be noted that the axis of rotation A-A is external to the stem 81.

Preferably, the stem 81 is oriented perpendicular to the base body 4, and particularly to the flat base surface 42. The stem 81 is configured to extend through the channel 25 defined by the jaws 24. The stem 81 is also configured to extend through the slit 72 of the engagement element 7.

In the first position, the stem 81 is inclined with respect to the second direction Y-Y, whereas in the second position the stem 81 extends in the second direction Y-Y, i.e. the vertical direction. For the stem to be able to move between the first position and the second position, the slit 72 is configured to allow the sliding motion and inclination of the stem 81 relative to the engagement element 7. Particularly, the slit 72 extends mainly in the third direction Z-Z.

The stem 81 has a free end 82 distal from the base body 4. The stem 81 also has a threaded portion 83. The threaded portion 83 is placed in a substantially central portion of the stem 81. The threaded portion 83 has a distal end 83A and a proximal end 83B, relative to the base body 4. The stem 81 also has a non-threaded, i.e. smooth portion 84. The non-threaded portion 84 is interposed between the free end 82 and the threaded portion 83 of the stem 81.

The threaded nut 85 is configured to be coupled by screwing to the threaded portion 83 of the stem 81 and to be rotatable freely when the non-threaded portion 84 of the stem 81 extends therethrough.

The threaded nut 85 is disposed between the fixing portion 71 of the engagement element 7 and the free end 82 of the stem 81. Preferably, the threaded nut 85 cannot be removed from the stem 81. Advantageously, the threaded nut 85 cannot be removed from the stem 81 due to the action of the elastic members 6.

In one aspect of the invention, in the first position the threaded portion 83 is arranged relative to the engagement element 7 so that the engagement element 7 will prevent the threaded nut 85 from engaging the threaded portion 83. Particularly, in the first position, the fixing portion 71 of the engagement element 7 is disposed between the threaded nut 85 and the distal end 83A of the threaded portion 83. Therefore, in the first portion the threaded portion 83 is disposed between the slit 72 and the base body 4. In other words, in the first position, the stem 81 extends through the slit 72 at the non-threaded portion 84 of the stem 81. Furthermore, in the first position, the stem 81 extends through the threaded nut 85 at the non-threaded portion 84.

As a result, in the first position, clamping of the clamping ring 21 by the clamping member 8 is not allowed. Therefore, in the first position, the threaded nut 85 cannot be screwed upon the threaded portion 83 of the stem 81.

In the second position, the threaded portion 83 of the stem 81 is arranged relative to the engagement element 7 so as to be engageable by the threaded nut 85. Particularly, in the second position, the threaded portion 83 at least partially emerges from the slit 72 of the fixing portion 71 of the engagement element 7 toward the threaded nut 85. Preferably, in the second position, the stem 81 extends through the slit 72 at the threaded portion 83. However, in the second position, the non-threaded portion 84 of the stem 81 is entirely interposed between the free end 82 of the stem 81 and the engagement element 7.

Therefore, in the second position, clamping of the clamping ring 21 by the clamping member 8 is allowed. In other words, in the second position, the threaded nut 85 can be screwed upon the threaded portion 83. It shall be noted that, during screwing, the threaded nut 85 moves in the second direction Y-Y, i.e. in a vertical direction.

As the threaded nut 85 is being screwed, it will cause the engagement element 7 to move in the second direction Y-Y toward the base body 4 and hence the jaws 24 to move toward each other to bring the clamping ring 21 in a clamping position. Particularly, as the threaded nut 85 is being screwed, it cooperates with the stem 81 to press the engagement element 7 on the jaws 24. More in detail, in the second position, the threaded nut 85 is adapted to act on the fixing portion 71 of the engagement element 7 to move the engagement element 7 in the second direction Y-Y.

Advantageously, clamping of the clamping ring 21 by the clamping member 8 is disabled as long as the base body 4 is in the first position. Clamping is allowed by moving the clamp 1 to the proper position relative to the terminal and the battery, and particularly by moving the base body 4 from the first position to the second position.

It shall be noted that, as the stem 81 moves from the first position to the second position, it rotates relative to the axis of rotation A-A, jointly with the base body 4. In this movement, the stem 81 slides in the slit 72 and tilts relative to the engagement element 7. In fact, as described above, in the first position the stem 81 is inclined with respect to the second direction Y-Y, whereas in the second position the stem 81 extends in the second direction Y-Y. Furthermore, in this movement, the threaded portion 83 at least partially emerges from the slit 72 toward the threaded nut 85. Thus, the threaded portion 83 will be engageable by the threaded nut 85 in the second position.

In the reverse movement, i.e. from the second position to the first position, the distal end 83A of the threaded portion 83 will move through the slit 72 toward the base body 4. As a result, in this movement, the fixing portion 71 of the engagement element 7 will be interposed between the threaded nut 85 and the distal end 83A of the threaded portion 83. It shall be noted that the threaded nut 85 cannot pass through the slit 72. Thus, the engagement element 7 prevents the threaded nut 85 from engaging the threaded portion 83 in the first position.

The invention claimed is:

1. A clamp for a male terminal, comprising:

a main body having a clamping ring and two jaws, the jaws being movable toward each other in a first direction to bring the clamping ring to a clamping position in which the clamping ring is configured to hold a male terminal, an engagement member movable relative to the main body in a second direction perpendicular to the first direction and acting on the jaws to move the jaws toward each other in the first direction, a clamping member operable to move the engagement member relative to the main body in the second direction, said clamping member comprising a stem with a threaded portion and a threaded nut coupled with the stem, wherein the clamp comprises a base body on which the stem is fixed, said base body is rotatably connected to the main body to switch between a first position, in which the stem is inclined with respect to the second direction, and a second position, in which the stem extends in the second direction, elastic members are interposed between the base body and the main body, and are configured to hold the base body in the first position, in the first position the threaded portion of the stem is arranged relative to the engagement member such that the engagement member prevents the threaded nut from engaging the threaded portion, in the second position the threaded portion of the stem is arranged relative to the engagement member such that it is engageable by the threaded nut.

2. The clamp as claimed in claim 1, wherein:

the engagement member has a fixing portion having a slit, the stem is configured to extend through the slit, and the slit is configured to allow the sliding and inclination of the stem relative to the engagement member, in the second position, the threaded nut is adapted to act on the fixing portion of the engagement member to move the engagement member in the second direction.

3. The clamp as claimed in claim 1, wherein:

the threaded portion has a distal end and a proximal end, relative to the base body, in the first position, the fixing portion of the engagement member is disposed between the threaded nut and the distal end of the threaded portion, in the second position, the threaded portion at least partially emerges from the slit towards the threaded nut.

4. The clamp as claimed in claim 1, wherein:

the stem has a free end distal from the base body and a non-threaded portion interposed between the free end and the threaded portion, in the first position, the stem extends through the threaded nut at the non-threaded portion.

5. The clamp as claimed in claim 2, wherein:

the stem has a free end distal from the base body and a non-threaded portion interposed between the free end and the threaded portion, in the first position, the stem extends through the threaded nut at the non-threaded portion, in the first position, the stem extends through the slit at the non-threaded portion, in the second position, the stem extends through the slit at the threaded portion.

6. The clamp as claimed in claim 1, wherein the elastic members are configured to be loaded in the second position.

7. The clamp as claimed in claim 1, comprising a hinge between the base body and the main body, the base body being hinged to the main body at said hinge to rotate relative to the main body.

8. The clamp as claimed in claim 7, wherein the clamping ring is interposed between the hinge and the jaws.

9. The clamp as claimed in claim 1, wherein:

in the first position, the base body is spaced from the clamping ring in the second direction.

10. The clamp as claimed in claim 1, wherein the stem is arranged perpendicularly with respect to the base body.

* * * * *